United States Patent [19]

Schaefer

[11] 4,217,962

[45] Aug. 19, 1980

[54] HYDRAULICALLY OPERATED GRADE SCRAPER

[76] Inventor: Michael J. Schaefer, Okarche, Okla. 73762

[21] Appl. No.: 948,934

[22] Filed: Oct. 5, 1978

[51] Int. Cl.[2] ..... E02F 3/64

[52] U.S. Cl. ..... 172/197; 172/413; 172/460; 172/421; 172/326; 172/611

[58] Field of Search ..... 172/197, 199, 396, 605, 172/200, 4, 784, 788, 781, 785, 413, 398, 460, 421; 37/129, 124 H, 124 R

[56] References Cited

U.S. PATENT DOCUMENTS

| | | | |
|---|---|---|---|
| 1,954,282 | 4/1934 | Cahall | 172/398 |
| 2,051,283 | 8/1936 | Austin | 37/129 |
| 2,078,500 | 4/1937 | Maloon | 172/781 X |
| 2,103,588 | 12/1937 | Le Bleu | 37/124 H |
| 3,058,243 | 10/1962 | McGee | 172/197 |
| 3,430,366 | 3/1969 | King | 37/129 |
| 3,724,557 | 4/1973 | Boschung | 172/197 |
| 4,055,222 | 10/1977 | Runte | 172/413 |

*Primary Examiner*—Richard J. Johnson
*Attorney, Agent, or Firm*—Robert K. Rhea

[57] ABSTRACT

A soil ripping tooth assembly is pivotally mounted for vertical movement within a horizontally disposed downwardly and forwardly open box frame having a drawbar and drawn by a prime mover having a hydraulic fluid supply system. A scraping blade is connected in depending relation with the rearward wall of the box frame for collecting soil within the confines of the box frame. A pair of wheels, journalled by stub axles, connected with a weight support frame in turn pivotally connected to the rearward side of the box frame, supports the box frame and ripper tooth assembly in combination with the drawbar. A plurality of hydraulic cylinders, mounted on the box frame and respectively connected with the drawbar, ripper tooth assembly and weight supporting frame, selectively tilt the ripper tooth assembly and respective sides and ends of the box frame toward and away from the surface of the earth in a soil collecting and distributing action.

2 Claims, 6 Drawing Figures

HYDRAULICALLY OPERATED GRADE SCRAPER

BACKGROUND OF THE INVENTION

1. Field of the Invention.

The present invention relates to earth working apparatus and more particularly to a tractor drawn soil grading and scraping implement.

2. Description of the Prior Art.

Earth leveling and grading devices have generally comprised a wheeled frame having a scraper blade or an earth scrapping and carrying unit either self-propelled or drawn by a tractor. Some prior art earth scraping blade devices are attached forwardly or rearwardly to a tractor, or the like. Other types of earth leveling devices have included ripping teeth usually attached to a bulldozer blade for loosening compacted soil or rocks for movement thereof in a leveling action by the blade.

This apparatus is distinctive over soil leveling implements presently in use by providing a wheel supported box frame having a depending scraper blade for movement of the box frame and blade toward and away from the earth in a forward and rearward tilting action with respect to the surface of the earth for collecting and moving soil in the direction of travel wherein the soil is released by gravity to fill in low areas over which the apparatus travels. The box frame is also tiltable laterally with respect to the lateral direction of travel to form an inclined surface for drainage away from a building or other structure. A ripping tooth assembly is pivotally supported within the box frame for vertical movement toward and away from the earth to loosen packed soil.

SUMMARY OF THE INVENTION

A horizontally disposed box frame, having an open top and bottom and an open forward side, is pivotally connected in trailing relation to a drawbar attached to the implement hitch of a prime mover, such as a tractor. A ripper assembly, having a plurality of earth ripping teeth, extends horizontally between and is pivotally connected with the end walls of the box frame for vertical movement toward and away from the surface of the earth. The rearward side wall of the box frame is provided with a coextensive depending grader blade. A weight supporting frame is pivotally connected by one longitudinal side edge with the rearward side wall of the box frame. Arms, pivotally connected with the respective ends of the weighed frame, are provided with stub axles journalling a pair of wheels for supporting the device in mobile fashion. Hydraulic wheel cylinders, respectively connected with the pivoting arms and weighted support frame, raise and lower the weight frame with respect to the surface of the earth. A front elevating hydraulic cylinder, extending between the front side of the box frame and drawbar, raises and lowers the front portion of the box frame toward and away from the surface of the earth. A rear elevating hydraulic cylinder, mounted on the box frame and connected by linkage to the weighted frame, elevates or lowers the rearward portion of the box frame toward and away from the surface of the earth. A ripper tooth hydraulic cylinder, mounted on the box frame, is connected by linkage to the ripper tooth assembly for raising and lowering the latter with respect to the box frame.

The principal objects of the present invention are to provide a soil working implement capable of being tilted forwardly and rearwardly for leveling the surface of the earth in a scraping action by the blade cutting, collecting and moving the earth from a higher point to a lower point in a scraping and dragging action including an earth ripping tooth assembly for loosening compacted soil and in which either end of the implement may be tilted upwardly with respect to its other end for forming a soil surface inclined laterally with respect to the direction of travel.

BACKGROUND OF THE PREFERRED EMBODIMENTS

Figure 1:
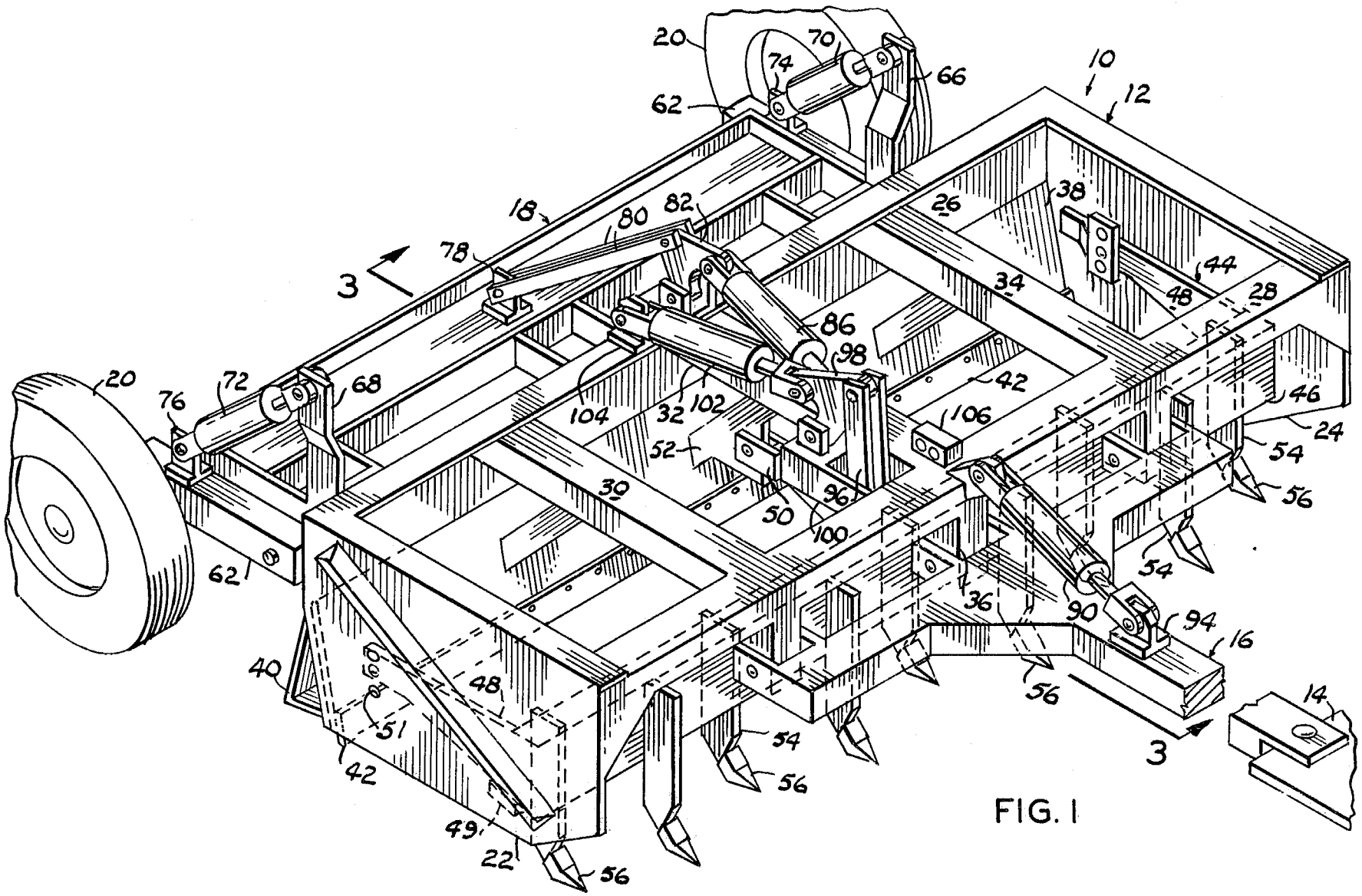
FIG. 1 is a forward fragmentary isometric view of the implement.
Figure 2:
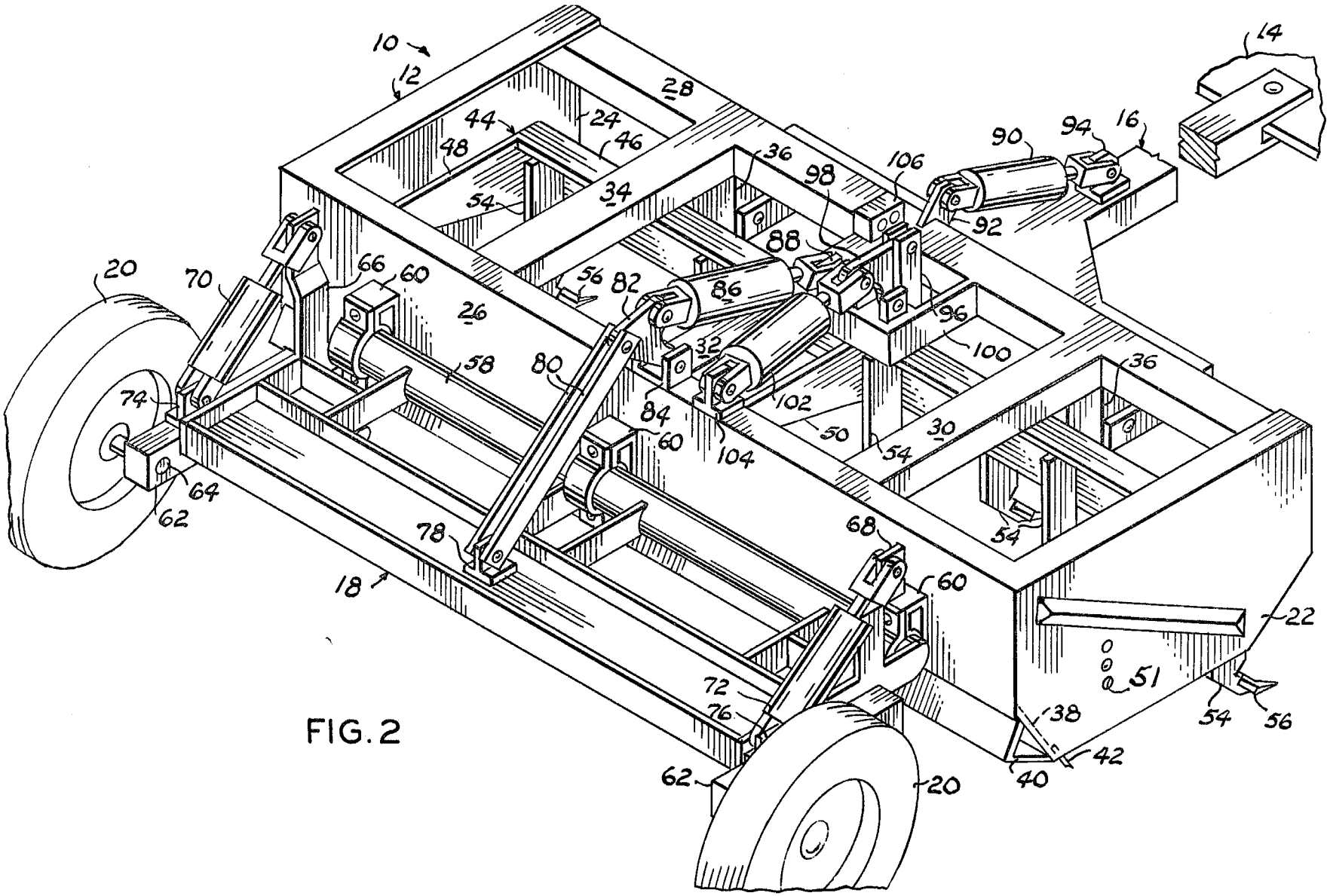
FIG. 2 is a rearward fragmentary isometric view of the implement.

Like characters of reference designate like parts in those figures of the drawings in which they occur.

In the drawings:

The reference numeral 10 indicates the device, as a whole, which is rectangular box in general configuration. The device 10 includes a box frame 12 connected with the implement hitch 14 of a prime mover, such as a tractor, not shown, by a drawbar 16. A weight support frame 18 is connected with the box frame 12 opposite the drawbar 16 and is supported by wheels 20.

The generally horizontally disposed box frame 12 extends transversely of the direction of travel and is characterized by vertical end walls 22 and 24 joined by a vertical rearward wall 26. The forward ends of the end walls 22 and 24 are joined at their upper limit by a front beam 28 thus defining a forwardly open front side and open bottom and top for the box frame. Intermediate its ends, the front beam is connected with the box frame rear wall 26 by a plurality of spaced-apart brace members 30, 32 and 34. The front beam is provided with a plurality of depending legs 36 for pivotal connection with the rearward end of the drawbar 16. The lower portion of the forward surface of the box frame rear wall 26 is provided with a coextensive downwardly and forwardly inclined plate forming a mold board 38 suitably braced against rearward movement with respect to the frame wall 26 by an angle iron member 40. A scraper blade 42, coextensive with the mold board 38, is connected in depending relation to its lower edge portion. The depending edge of the scraper blade 42 preferably depends below the lower limit of the box frame as defined by the depending edges of the box frame walls and rear wall.

A ripper assembly 44 is pivotally mounted for vertical movement toward and away from the surface of the earth within the box frame 12. The ripper tooth assembly 44 includes a tooth support bar 46 extending horizontally between the box frame end walls 22 and 24 and pivotally connected for vertical movement by end arms 48 to the inner wall surface of the respective frame end walls 22 and 24 by bolts extending through one of a series of apertures 51 formed therein with downward movement of the tooth assembly 44 limited by stops 49 secured to the inner surface of the respective box frame end wall. An intermediate arm 50, secured to the tooth support bar 46, is pivotally connected with an angle brace 52 extending between the beam brace 32 and rearward wall 26. A plurality of plate-like earth ripping teeth 54 are rigidly connected in longitudinal rows to the tooth support bar 46 in depending longitudinally spaced-apart forward and rearward staggered relation. Each of the ripping teeth 54 is provided with a replaceable tip 56.

The weight support frame 18 includes a coextensive forward side tube member 58 pivotally connected by a plurality of clamps 60 secured in horizontally spaced relation, to the rearward surface of the box frame wall 26 intermediate its height. A pair of wheel support arms 62 are pivotally connected at one end to the forward portion of the respective end of the weighted frame 18 for vertical pivoting movement of their opposite ends toward and away from the surface of the earth. The trailing end of the wheel support arms 62 are each provided with a stub axle 64 which journals the wheels 20. A pair of standards 66 and 68 are connected in upstanding relation to the respective ends of the weighted frame adjacent the pivotal connection of the respective wheel support arm 62. A pair of hydraulic wheel cylinders 70 and 72, respectively, connected with the upper end portion of the standards 66 and 68, are connected by a pair of brackets 74 and 76 with the rearward end portion of the respective wheel support arm 62 for the purposes presently explained.

A bracket 78, mounted on the rearward side portion of the weighted frame 18 intermediate its ends, is connected, by links 80, with one arm of a bell crank 82 pivotally supported by a bracket 84 mounted on the upper limit of the box frame forward wall 26. The other arm of the bell crank 82 is connected with one end of a box frame rear portion elevating hydraulic cylinder 86 connected at its other end with a lug 88 mounted on the box frame beam 32, intermediate its ends, for supporting and tilting the box frame, as presently explained.

A box frame front portion elevating hydraulic cylinder 90 is connected with ears 92 and 94, respectively, connected with the frame front beam 28 and drawbar 16 for cooperating with the hydraulic cylinder 86 and raising and lowering the box frame in a forward or rearward tilting action, as presently explained.

The ripping tooth assembly 44 is provided with a pair of links 96 pivotally connected with the tooth support bar 46 and one arm of a second bell crank 98 pivotally supported between lugs mounted on a lateral extension 100 secured to the front beam 32. A ripping tooth assembly control hydraulic cylinder 102 extends between and is connected with the other arm of the bell crank 98 and a lug 104 mounted on the upper limit of the box frame rearward wall 26 for raising and lowering the tooth assembly 44 with respect to the box frame.

A source of hydraulic fluid pressure supplied by the tractor, not shown, is connected in a conventional manner by tubing, not shown, to the tooth assembly cylinder 102 and to the other hydraulic cylinders through a distributor valve 106 so that the wheel cylinders 70 and 72, when activated, operate in opposite directions and similarly the hydraulic cylinders 86 and 90 are operated in opposite directions.

Figure 4:
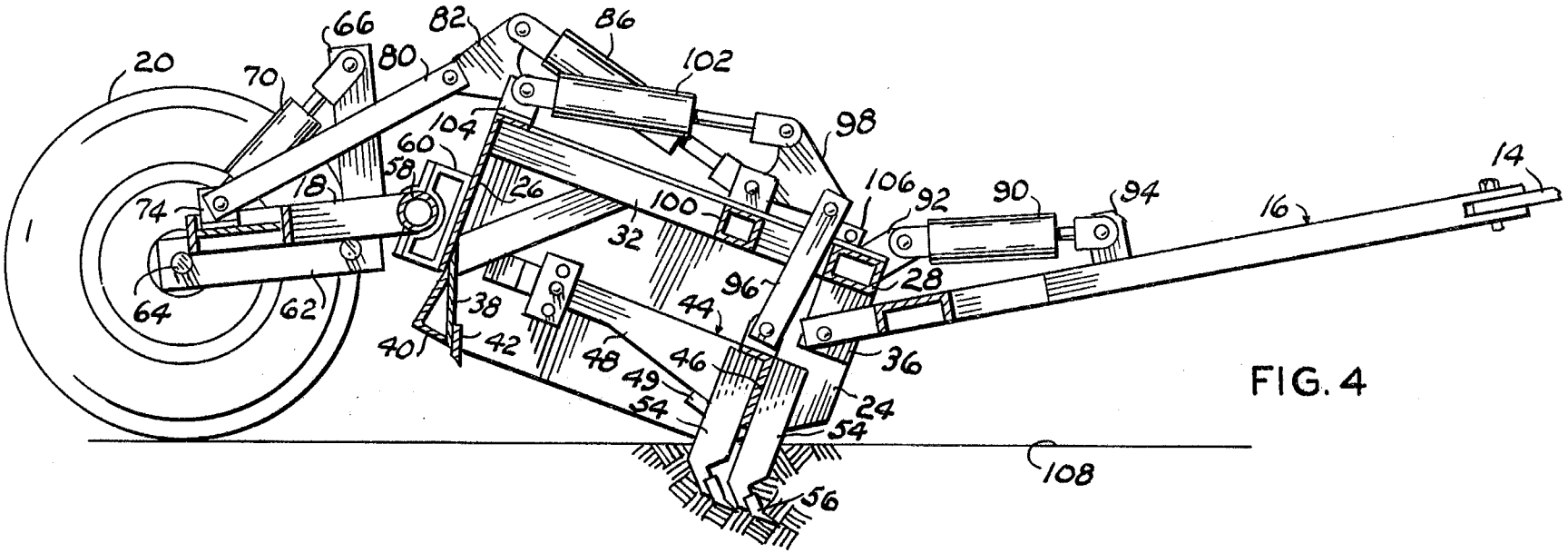
FIG. 4 is a vertical cross sectional view similar to FIG. 3 illustrating the box frame and ripping tooth assembly tilted downwardly and forwardly for an earth ripping action.
Figure 5:
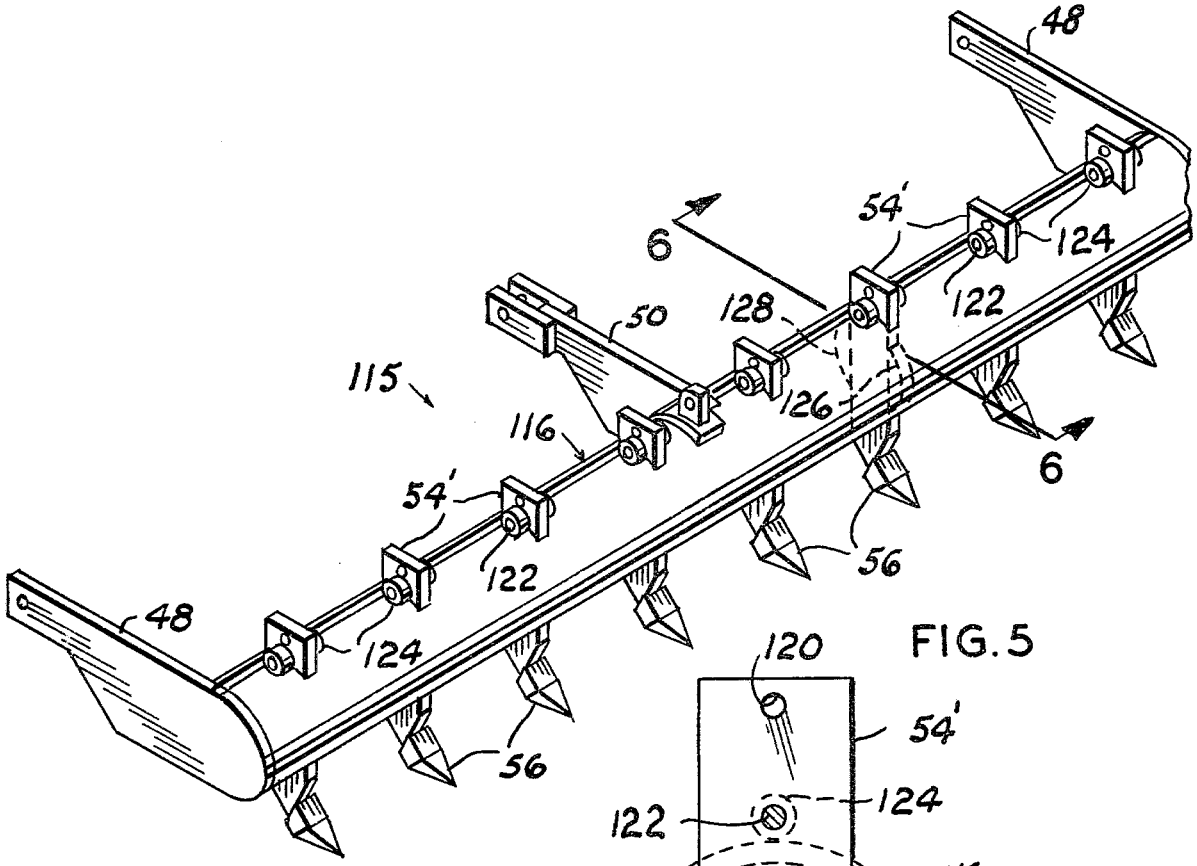
FIG. 5 is an isometric view of another embodiment of the ripper tooth assembly, per se; and, FIG. 6 is a vertical cross sectional view, partially in elevation, to a larger scale, taken substantially along the line 6—6 of FIG. 5.
Figure 6:
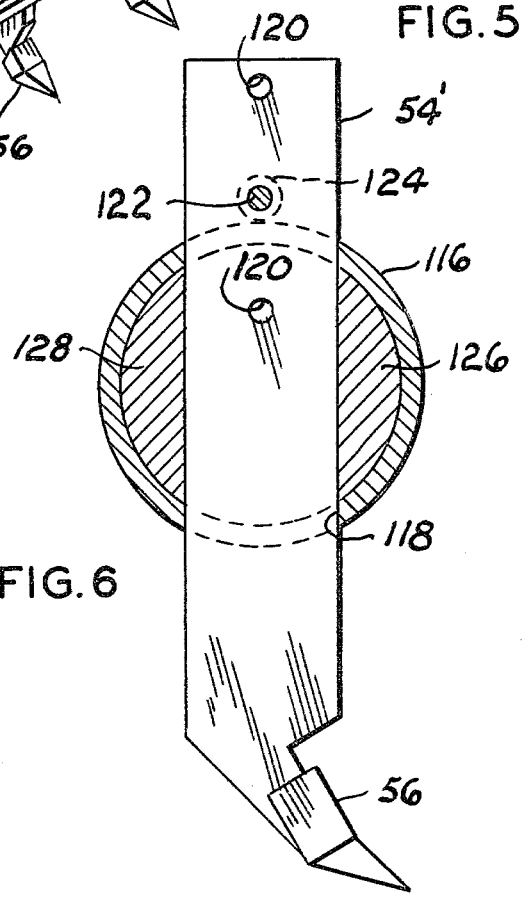

Referring more particularly to FIGS. 5 and 6, the reference numeral 115 indicates another embodiment of the ripper assembly in which the support bar 46 is replaced by an elongated tube 116 similarly connected at its respective ends and intermediate its ends with the end arms 48 and intermediate arm 50. The tube 116 is vertically slotted in longitudinally spaced relation, as at 118, for slidably receiving a plurality of the ripping teeth 54', each having one of the replaceable tips 56. Each ripping tooth 54' is provided, in its upper end portion, with a series of longitudinally spaced transverse apertures 120 for receiving a pin 122 extending through centrally drilled lugs 124 rigidly secured to the periphery of the tube 116 on opposing sides of the respective tooth. This permits the teeth 54' to be vertically adjusted with respect to the tube 116. The series of apertures 51 in the respective frame end wall 22 and 24, permits the ripping tooth assembly 115 to be adjusted so that the ripping teeth 54' are substantially vertically disposed when in a lowered earth ripping action and the box frame 12 is tilted in a forward and downward direction (FIG. 4). The bore of the tube 116 is provided with a plate-like half moon or substantially semicircular segments 126 and 128, respectively, aligned with and contacting the opposing edge surface of the respective tooth 54' within the tube 116. Obviously, the several segments 126 and 128 may comprise two elongated members, not shown, coextensive with the tube 116, each having a substantially semicircular transverse section, if desired.

Operation

Figure 3:
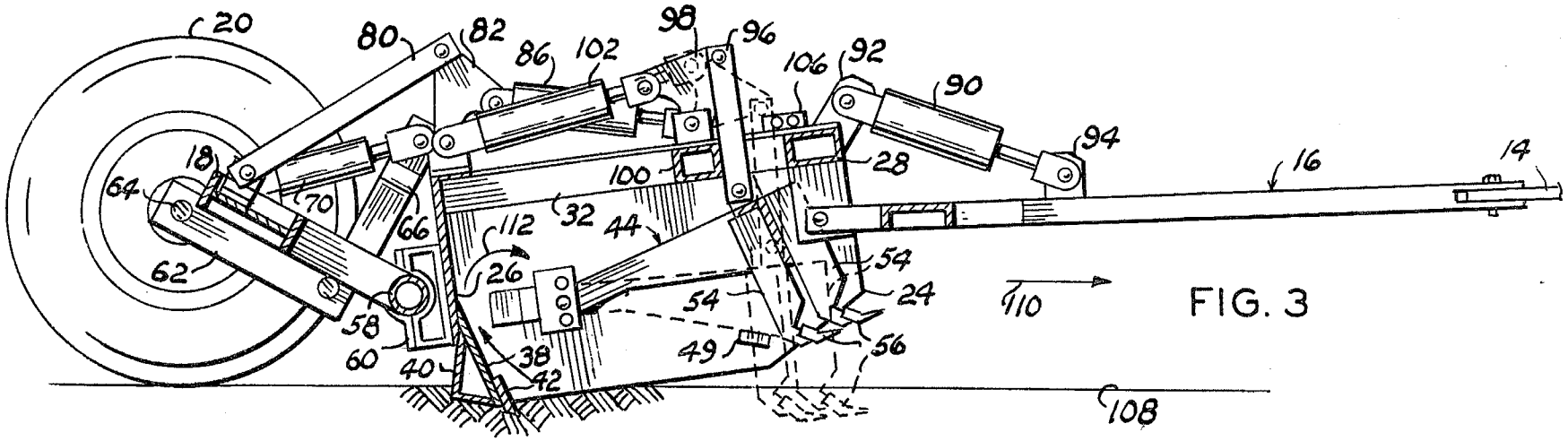
FIG. 3 is a view taken substantially along the line 3—3 of FIG. 1 illustrating the rearward portion of the box frame tilted downwardly in a soil cutting and scraping action with the ripper tooth assembly in an elevated position.

When leveling soil on the surface of the earth, as shown by FIG. 3, the cylinder 86 is retracted so that the linkage 80 and bell crank 82 lift the rearward side portion of the weighted frame 18 with respect to the box frame 12, by the pivoting action of the tubing 58 within the brackets 60, effecting a lowering action of the rearward portion of the box frame toward the surface of the earth 108 so that the scraper blade 42 contacts and enters the earth. Simultaneously, the cylinder 90 is extended and elevates the forward portion of the box frame by bearing against the drawbar. When the device 10 is drawn forward in the direction of the arrow 110 soil is scraped or cut by the blade 42 and moves upwardly across the surface of the mold board 38 and falls forwardly within the confines of the box frame 12 in the direction shown by the arrows 112 with such soil being deposited in a spreading action when the device moves across lower areas in the surface of the earth. During this action the ripper assembly 44 is normally in the solid line position of FIG. 3 but may be lowered, by the hydraulic cylinder 102, toward its dotted line position to form a ripping action on the surface of the earth.

Soil moved by the device may be deposited on an incline by shifting the distributor valve 106 to another position for actuating the wheel supporting cylinders 70 and 72 in opposite directions which pivots the rearward end portion of one of the wheel support arms 62 upwardly and the other one downwardly with respect to the plane of the weight supporting frame 18 thus disposing the box frame on an incline with respect to the surface of the earth in a direction normal to the direction of travel so that the soil moved by the scraper blade is deposited to form an inclined surface adjacent a building, or the like, not shown.

FIG. 4 illustrates the device when the box frame is tilted to dispose its forward portion adjacent the surface of the earth and its rearward portion elevated with the ripper tooth assembly lowered by the hydraulic cylinder 102 so that the ripping teeth 54 may loosen compacted soil. This tilted position of the box frame is accomplished by operating the hydraulic cylinders 86 and 90 in opposite directions from that described hereinabove for FIG. 3 wherein the cylinder 86 lifts the rearward wall 26 of the box frame with respect to the rearward portion of the weighted frame 18 and the forward cylinder 90 lifts the forward end portion of the drawbar 16 with respect to the box frame.

I have found that the box frame front elevating cylinder 90 may be replaced with an elongated longitudinally adjusted connector, such as a conventional turnbuckle, not shown, and that one of the wheel elevating cylinders 70 or 72 may be replaced by such a turnbuckle. It, also, seems obvious that the box frame rear elevating cylinder 86 may be directly connected between the weighted frame bracket 78 and rearward upper limit of the box frame thus eliminating the pair of links 80 and the bell crank 82.

Obviously the invention is susceptible to changes or alterations without defeating its practicability. Therefore, I do not wish to be confined to the preferred embodiment shown by the drawings and described herein.

I claim:

1. A drag scraper comprising:

a box frame adapted to be drawn by a prime mover having a hydraulic fluid supply system, said box frame extending transversely of the direction of travel and having vertical end walls joined by a rear wall defining an open bottom and a forwardly open side;

a beam extending between the upper limit of said end walls at the forward side of said box frame;

a forwardly projecting drawbar pivotally connected at its rearward end with said beam;

an elongated longitudinally adjustable drawbar lift member extending between and connected with said beam and said drawbar intermediate their ends;

a scraper blade longitudinally secured to the depending portion of said rear wall and adapted to scrape soil against the forward side thereof on forward movement;

a generally rectangular weighted frame pivotally connected by one longitudinal edge portion to the rearward surface of said box frame rear wall for vertical pivoting movement of its other longitudinal edge portion toward and away from the surface of the earth, said weighted frame having a forward upstanding standard at its respective ends;

wheel means connected with said weighted frame for supporting the latter and said box frame in a mobile manner, said wheel means including, a pair of arms pivotally connected at one end respectively with the respective end of said weighted frame, a pair of stub axles connected respectively with the other end of said pair of arms, a pair of wheels journalled by said stub axles, and, an elongated longitudinally adjustable wheel lift member extending between and connecting said other end of said pair of arms with the respective said standard for raising and lowering the respective end portion of said weighted frame in a tilting action; and, means including a hydraulic cylinder pivotally connecting said weighted frame other edge portion with said box frame for raising and lowering said box frame in a forward and rearward tilting action toward and away from the surface of the earth.

2. The drag scraper according to claim 1 and further including:

a ripping tooth assembly extending between and pivotally connected with said end walls for vertical movement through the box frame open bottom, said ripping tooth assembly including at least one row of generally vertically disposed earth ripping teeth disposed adjacent the box frame forwardly open front; and, a tooth assembly hydraulic cylinder connecting said tooth assembly with said box frame.

* * * * *